US010494891B2

(12) United States Patent
Mozisek et al.

(10) Patent No.: US 10,494,891 B2
(45) Date of Patent: Dec. 3, 2019

(54) WIRELINE VALVE WITH FLAPPER

(71) Applicant: Cameron International Corporation, Houston, TX (US)

(72) Inventors: Taylor Mozisek, Katy, TX (US); Nicolas Arteaga, Jersey Village, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 64 days.

(21) Appl. No.: 15/719,975

(22) Filed: Sep. 29, 2017

(65) Prior Publication Data

US 2019/0100974 A1 Apr. 4, 2019

(51) Int. Cl.

| | |
|---|---|
| ***E21B 33/06*** | (2006.01) |
| ***E21B 34/02*** | (2006.01) |
| *E21B 34/00* | (2006.01) |

(52) U.S. Cl.

CPC ..... *E21B 33/062* (2013.01); *E21B 34/02* (2013.01); *E21B 2034/005* (2013.01)

(58) Field of Classification Search

CPC .. E21B 33/062; E21B 34/02; E21B 2034/005; E21B 19/24; F16K 15/035

See application file for complete search history.

(56) References Cited

U.S. PATENT DOCUMENTS

| | | | | |
|---|---|---|---|---|
| 2,896,721 A * | 7/1959 | Cannaday | E21B 43/116 175/214 |
| 3,957,113 A | 5/1976 | Jones et al. | |
| 4,508,313 A * | 4/1985 | Jones | E21B 33/063 251/1.3 |
| 4,681,168 A * | 7/1987 | Kisling, III | E21B 33/072 166/381 |
| 4,770,387 A | 9/1988 | Grranger | |
| 4,907,650 A * | 3/1990 | Heinonen | E21B 33/08 166/80.1 |
| 5,875,841 A * | 3/1999 | Wright | E21B 33/062 137/614.19 |
| 2008/0277122 A1* | 11/2008 | Tinnen | E21B 23/14 166/339 |

FOREIGN PATENT DOCUMENTS

| | | | |
|---|---|---|---|
| WO | 2013/090597 A1 | 6/2013 | |
| WO | 2017/019547 A1 | 2/2017 | |
| WO | 2017/030875 A1 | 2/2017 | |
| WO | WO-2017019547 A1 * | 2/2017 | E21B 33/062 |

OTHER PUBLICATIONS

International Search Report and Written Opinion for the equivalent International patent application PCT/US2018/053453 dated Jan. 25, 2019.

* cited by examiner

*Primary Examiner* — Michael R Wills, III
(74) *Attorney, Agent, or Firm* — Helene Raybaud

(57) ABSTRACT

Wireline valves with internal tool trap flappers are provided. In one embodiment, a wireline valve includes a main body with a bore sized to allow a downhole tool to pass through the main body of the wireline valve and a flapper positioned within the main body. The flapper is positioned with respect to the bore of the wireline valve such that the flapper can be moved between an open position that permits passage of the downhole tool through the bore of the main body of the wireline valve and a closed position that prevents passage of the downhole tool through the bore of the main body of the wireline valve in at least one direction. Additional systems, devices, and methods are also disclosed.

18 Claims, 12 Drawing Sheets

WIRELINE VALVE WITH FLAPPER

BACKGROUND

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In order to meet consumer and industrial demand for natural resources, companies often invest significant amounts of time and money in finding and extracting oil, natural gas, and other subterranean resources from the earth. Particularly, once a desired subterranean resource such as oil or natural gas is discovered, drilling and production systems are often employed to access and extract the resource. These systems may be located onshore or offshore depending on the location of a desired resource.

Further, such systems generally include a wellhead assembly through which the resource is accessed or extracted. These wellhead assemblies may include a wide variety of components, such as various casings, valves, fluid conduits, and the like, that control drilling or production operations. More particularly, wellhead assemblies often include blowout preventers, such as a ram-type preventer that uses one or more pairs of opposing rams to restrict flow of fluid through the blowout preventer or to shear through a drill string or another object within the blowout preventer. Various tools can be run into wells through the wellhead assemblies for formation evaluation or sampling. In some instances, such tools are lowered into wells by cables (e.g., wirelines or slicklines) and blowout preventers of the wellhead assemblies are used as wireline valves to seal about the cables.

SUMMARY

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

Some embodiments of the present disclosure generally relate to wireline valves with internal tool trap flappers. When such wireline valves are installed in wellhead assemblies over wells, the internal tool trap flappers allow tools to pass upward through the wireline valve while preventing the tools from falling downhole through the wireline valves. In some embodiments, a wireline valve includes a hollow main body with a ram cavity and a rotatable flap that is positioned above the ram cavity and selectively prevents passage of tools through the wireline valve. In other embodiments, a wireline valve includes a ram having a rotatable flap, and the ram can be moved within the wireline valve to position the rotatable flap in a bore of the wireline valve to selectively prevent passage of tools through the bore.

Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

These and other features, aspects, and advantages of certain embodiments will become better understood when the following detailed description is read with reference to the accompanying drawings in which like characters represent like parts throughout the drawings, wherein.

DETAILED DESCRIPTION OF SPECIFIC EMBODIMENTS

Specific embodiments of the present disclosure are described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time-consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements. Moreover, any use of "top," "bottom," "above," "below," other directional terms, and variations of these terms is made for convenience, but does not require any particular orientation of the components.

Wells are generally drilled into subsurface rocks to access fluids, such as hydrocarbons, stored in subterranean formations. The formations penetrated by a well can be evaluated for various purposes, including for identifying hydrocarbon reservoirs within the formations. During drilling operations, one or more drilling tools in a drill string may be used to test or sample the formations. Following removal of the drill string, a wireline tool may also be run into the well to test or sample the formations. These drilling tools and wireline tools, as well as other wellbore tools conveyed on coiled tubing, slickline, drill pipe, casing, or other means of conveyance, are also referred to herein as "downhole tools." A downhole tool may be employed alone or in combination with other downhole tools in a downhole tool string.

The measurements taken by downhole tools may be used, for example, to determine downhole conditions or to identify characteristics of formations surrounding boreholes in which the downhole tools are deployed. Some downhole tools include sensors for measuring downhole parameters, such as temperature, pressure, viscosity, resistivity, and the like. Downhole tools can also include various imaging devices and logging devices. The measurements acquired via such downhole tools may be useful in assessing downhole conditions, understanding formation characteristics, and directing oilfield operations.

Figure 1:
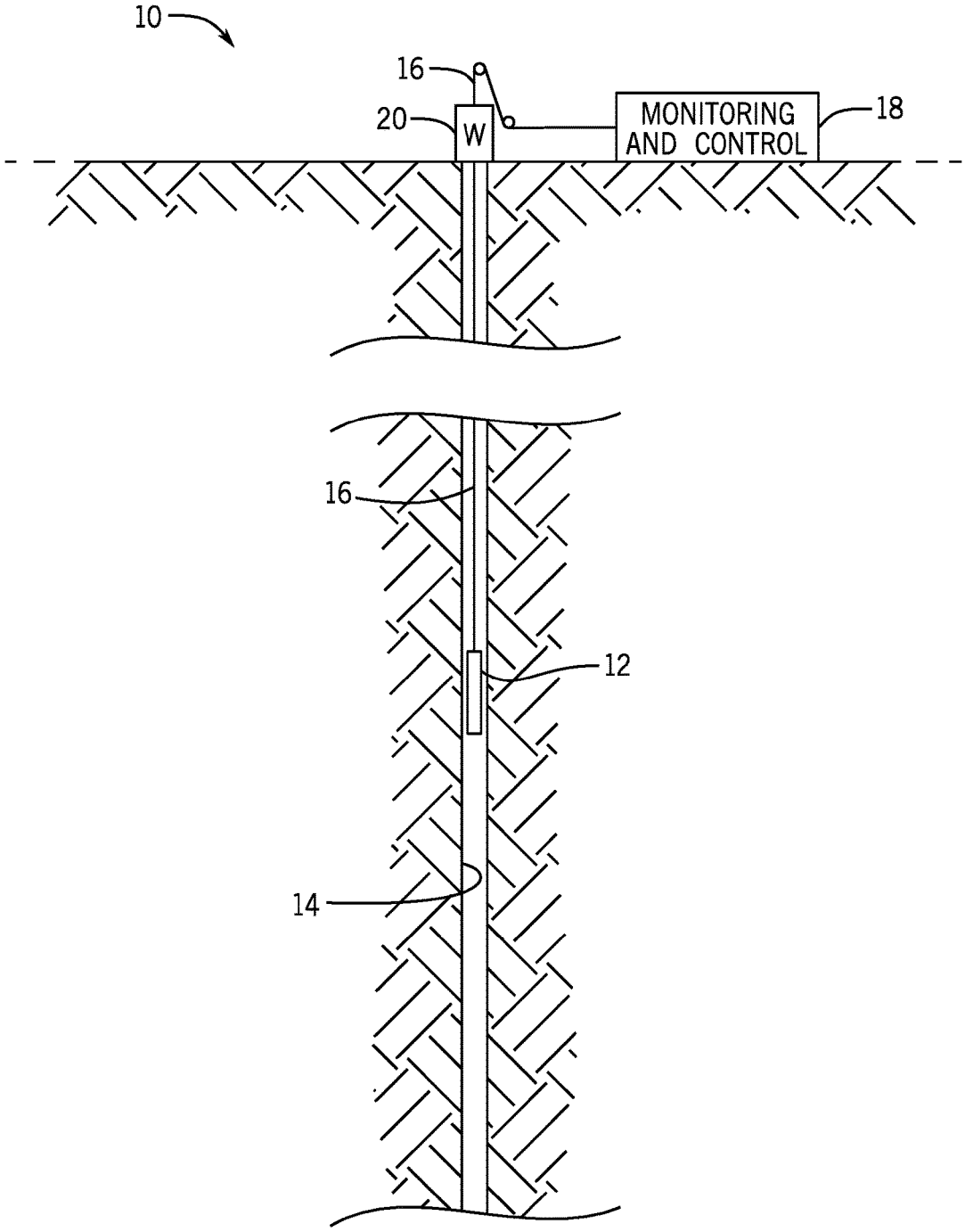
FIG. 1 generally depicts an apparatus including a downhole tool deployed within a well on a cable in accordance with one embodiment of the present disclosure.

Turning now to the drawings, an apparatus 10 for measuring downhole parameters in a well is depicted in FIG. 1 in accordance with one embodiment. In this depicted embodiment, a downhole tool 12 is suspended in a well 14 on a cable 16. The downhole tool 12 could be deployed in the well 14 as a single tool or as multiple tools coupled together in a tool string. The cable 16 may be a wireline cable with at least one conductor that enables data transmission between the downhole tool 12 and a monitoring and control system 18. In another embodiment, the cable 16 is a slickline. The downhole tool 12 may be raised and lowered within the well 14 (which may also be referred to as a borehole) via the cable 16 in any suitable manner. For instance, the cable 16 can be reeled from a drum in a service truck, which may be a logging truck having the monitoring and control system 18. Although the downhole tool 12 is depicted in FIG. 1 as being deployed via a cable, the downhole tool 12 could be deployed within the well 14 in any other suitable manner. Further, while the apparatus 10 is shown in FIG. 1 at an onshore well 14, the apparatus 10 could be used with an offshore well in full accordance with the present techniques.

The monitoring and control system 18 controls movement of the downhole tool 12 within the well 14 and receives data from the downhole tool 12. The monitoring and control system 18 can include one or more computer systems or devices. The system 18 can receive data from the downhole tool 12, and this data can be stored, communicated to an operator, or processed. Although generally depicted in FIG. 1 at a wellsite, it is noted that the system 18 could be positioned elsewhere, and that the system 18 could be a distributed system with elements provided at different places near or remote from the well 14. For example, a local component of the system 18 may be located at the wellsite for controlling operation of the downhole tool 12 and receiving data from the tool 12, but the received data could be processed by a different portion of the system 18 at another location.

Figure 2:
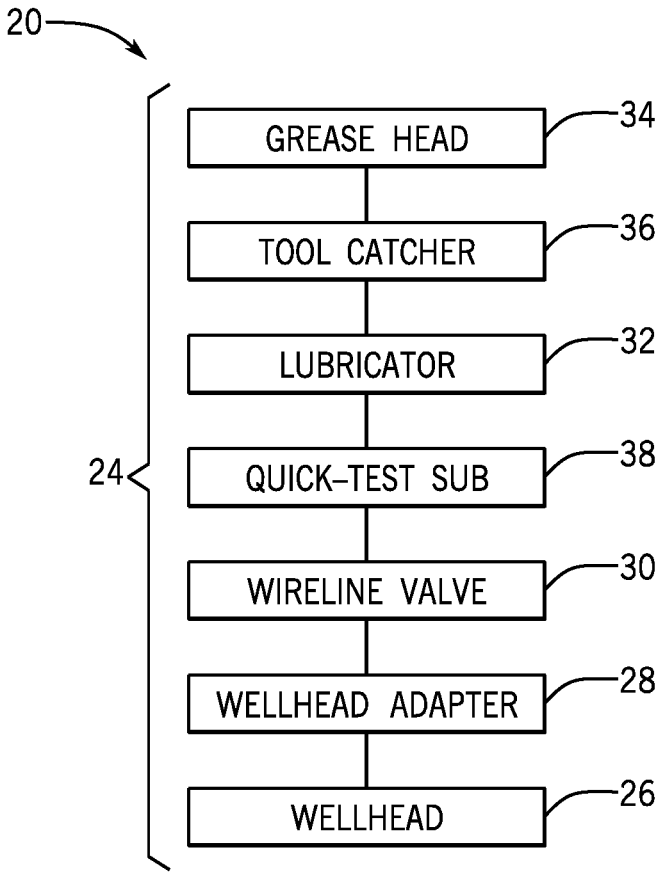
FIG. 2 is a block diagram depicting a wellhead assembly of the apparatus of FIG. 1 in accordance with one embodiment.

The downhole tool 12 can be lowered via the cable 16 into the well 14 through a wellhead assembly 20. By way of example, various components of a wellhead assembly 20 having stack equipment 24 installed at a wellhead 26 are depicted in FIG. 2 in accordance with one embodiment. The depicted stack equipment 24, which may also be referred to as a stack assembly or a pressure-control string, includes a wellhead adapter 28 for facilitating connection of the stack equipment 24 to the wellhead 26.

The stack equipment 24 also includes a wireline valve 30 coupled above the adapter 28 and a lubricator 32 coupled above the wireline valve 30. As will be understood by the skilled artisan, the wireline valve 30 (e.g., a wireline blowout preventer) may be closed to seal about the cable 16, and the lubricator 32 can include one or more pipes for receiving the tool 12 and facilitating running of the tool 12 into and out of the well 14. Further, the cable 16 may be run through a grease head 34 coupled above the lubricator 32. High-pressure grease can be pumped into the grease head 34 to form a seal while allowing the cable 16 to be raised or lowered through the grease head 34.

As noted above, the downhole tool 12 can be raised and lowered within the well 14 via the cable 16. When the tool 12 is to be removed from the well, the cable 16 can be raised to pull the tool 12 up through the wellhead 26 and into the lubricator 32. If the cable 16 continues to be reeled in after the tool 12 is in the lubricator 32, the cable 16 could disconnect from the tool 12. Accordingly, the stack equipment 24 can include features for preventing a tool 12 in the lubricator 32 from falling into the well 14 through the wellhead 26 following inadvertent disconnection of the tool 12 from the cable 16. For example, the stack equipment 24 can include a tool catcher 36 coupled at the top of the lubricator 32 for securely gripping an upper end of the tool 12 pulled into the tool catcher 36. The stack equipment 24 can also or instead include a tool trap below the lubricator 32 to prevent a disconnected tool 12 in the lubricator 32 from falling through the wellhead 26 into the well 14. Such a tool trap could be installed between the lubricator 32 and the wireline valve 30. But in at least some embodiments, and as discussed in greater detail below, a tool trap is instead incorporated into the wireline valve 30. The depicted stack equipment 24 also includes a quick-test sub 38 above the wireline valve 30 for facilitating connection of the lubricator 32.

Although the stack equipment 24 is described above as having certain components, it will be appreciated that the stack equipment 24 could have other components in addition to, or in place of, those described above. A few examples of such other components include a stuffing box, a cable cutter, a valve, and a sheave for running the cable 16 into the wellhead assembly 20. Additionally, although the stack equipment 24 may be connected directly to the wellhead 26 in some embodiments, in other instances the stack equipment 24 could be connected via an intermediate device, such as a production tree mounted on the wellhead 26.

As noted above, the stack equipment 24 could include a tool trap installed as a separate component between the wireline valve 30 and the lubricator 32. But in at least some embodiments such a tool trap is omitted (i.e., the stack equipment 24 does not include a tool trap coupled between the wireline valve 30 and the lubricator 32) and a flapper is instead provided within the body of the wireline valve 30. The inclusion of a tool trap flapper within the wireline valve 30 allows a separate, dedicated tool trap to be omitted, which reduces the height, weight, leak paths, and set-up time of the stack equipment 24 in at least some instances.

Figure 3:
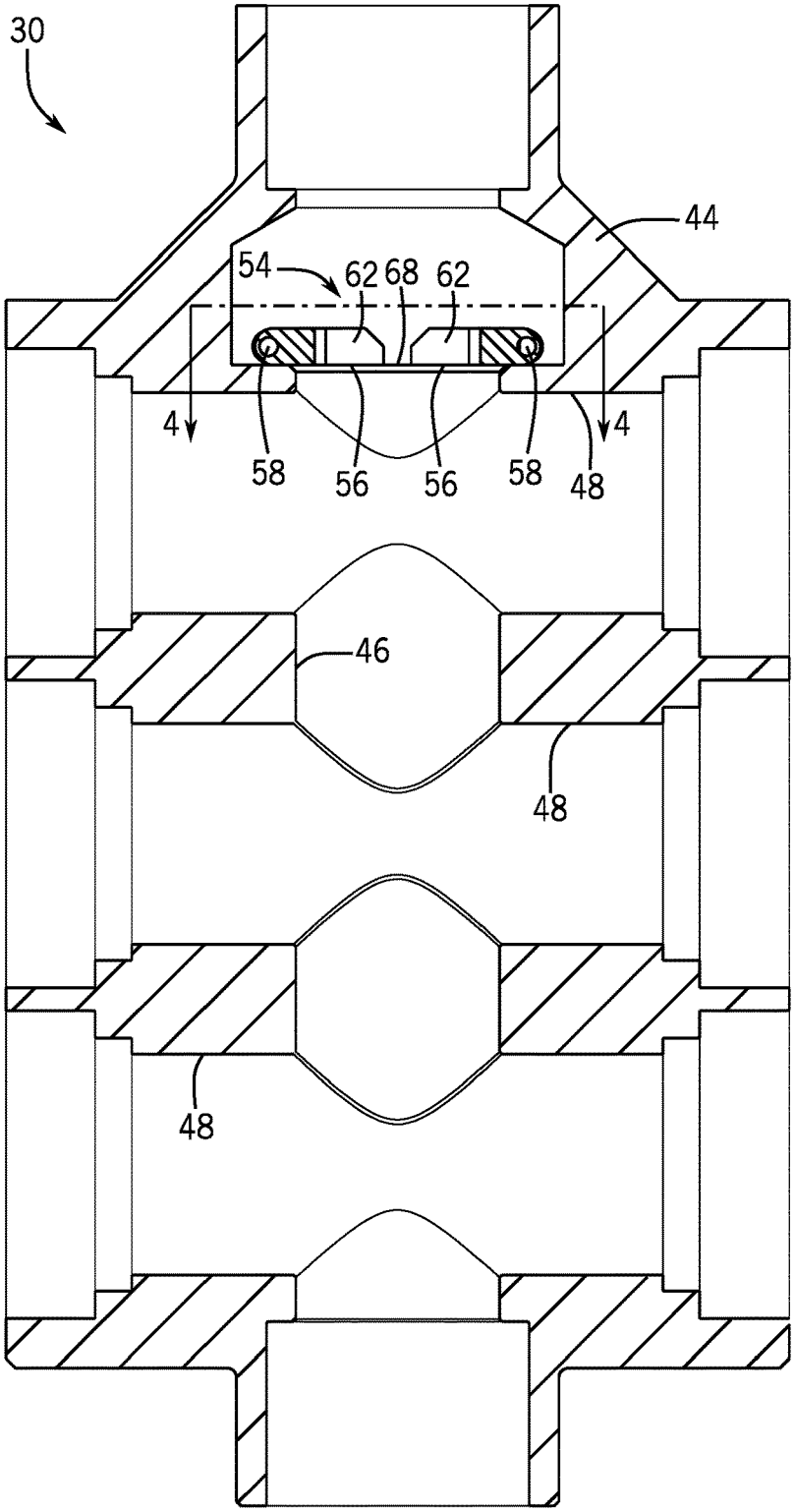
FIG. 3 is a vertical cross-section of a wireline valve of the wellhead assembly of FIG. 2 having a bore and an internal tool trap flapper to selectively impede movement of the downhole tool through the bore in accordance with one embodiment.

An example of a wireline valve 30 having a flapper is depicted in FIG. 3. In this depicted embodiment, the wireline valve 30 includes a main valve body 44 with a bore 46 that allows passage of objects through the valve 30. For example, the downhole tool 12 can be lowered from the lubricator 32 into the well 14 through the valve 30 and then later drawn back into the lubricator 32 from the well 14 through the valve 30. As presently shown, the wireline valve 30 is a triple-ram blowout preventer with three ram cavities 48 for three pairs of rams (e.g., sealing rams). In other embodiments, however, the wireline valve 30 could be provided with some other number of ram cavities 48, such as a single-ram blowout preventer with one ram cavity 48, a double-ram blowout preventer with two ram cavities 48, or a quadruple-ram blowout preventer with four ram cavities 48. Rams may be installed in the ram cavities 48, and the number, types, sizes, and shapes of the rams may differ as desired based on the intended applications.

The wireline valve 30 in FIG. 3 includes a flapper 54 that inhibits undesired passage of the downhole tool 12 down through the bore 46 (e.g., from the lubricator 32) while allowing the passage of the downhole tool 12 up through the bore 46 (e.g., from the well 14 through the wellhead 26). The flapper 54 is shown in its closed position in FIG. 3, in which the flapper 54 extends into the bore 46 and operates similarly to a check valve in that the closed flapper 54 permits passage of the tool 12 in one direction through the bore 46 while impeding passage of the tool 12 in the opposite direction. As discussed further below, the flapper 54 may be moved into an open position that allows the tool 12 to be lowered, via the cable 16, from the lubricator 32 into the well 14 through the wireline valve 30.

Figure 4:
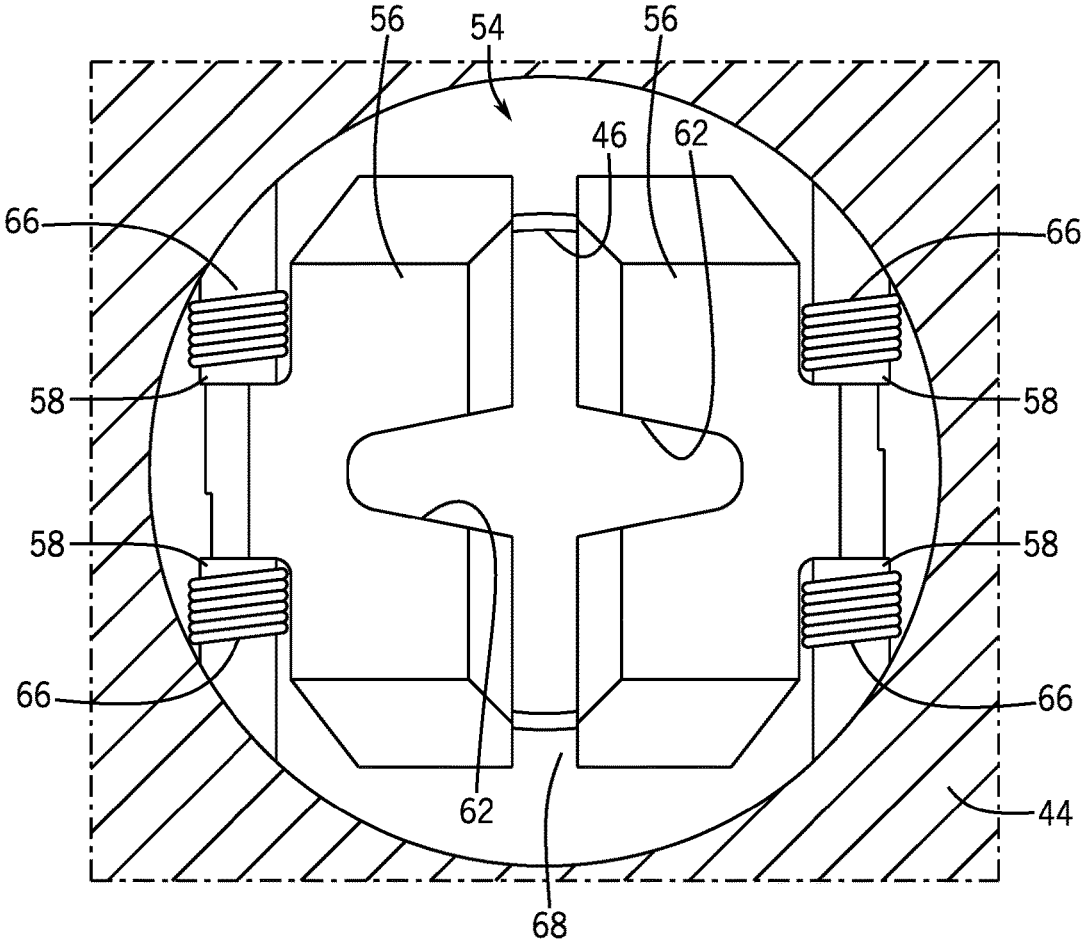
FIG. 4 is a horizontal cross-section of the wireline valve of FIG. 3 showing rotatable doors of the flapper in accordance with one embodiment.

In the presently depicted embodiment, the flapper 54 includes opposing doors 56, which may also be referred to as flaps. These doors 56 are rotatable about pivots 58, such as pins or other axles, to facilitate passage of the tool 12 or other objects through the flapper 54. As best shown in FIG. 4, the doors 56 include recesses or slots 62 sized to allow the cable 16 to be raised or lowered freely through the closed flapper 54 while still allowing the doors 56 to block downward travel of the tool 12 through the flapper 54. Although shown as generally U-shaped slots in FIG. 4, the slots 62 can be provided in any other suitable form. In some instances, the slots 62 may be omitted and the cable 16 can be raised or lowered through the closed flapper 54 through a gap between the closed doors 56.

In at least some embodiments, the flapper 54 is biased toward its closed position. For example, the flapper 54 can include springs 66 that apply a biasing force to the doors 56. The springs 66 depicted in FIG. 4 are torsion springs that apply a biasing torque to the doors 56 toward the closed position shown in FIGS. 3 and 4, but different springs (such as compression or tension springs) could be used in other embodiments. In at least some embodiments, including that shown in FIGS. 3 and 4, the doors 56 of the flapper 54 rest against a shoulder 68 of the valve body 44 when in the closed position. The shoulder 68 can serve as a stop that limits further rotation of the doors 56 as the doors close and provides support for the doors 56 during loading (e.g., when catching a tool 12).

Figure 5:
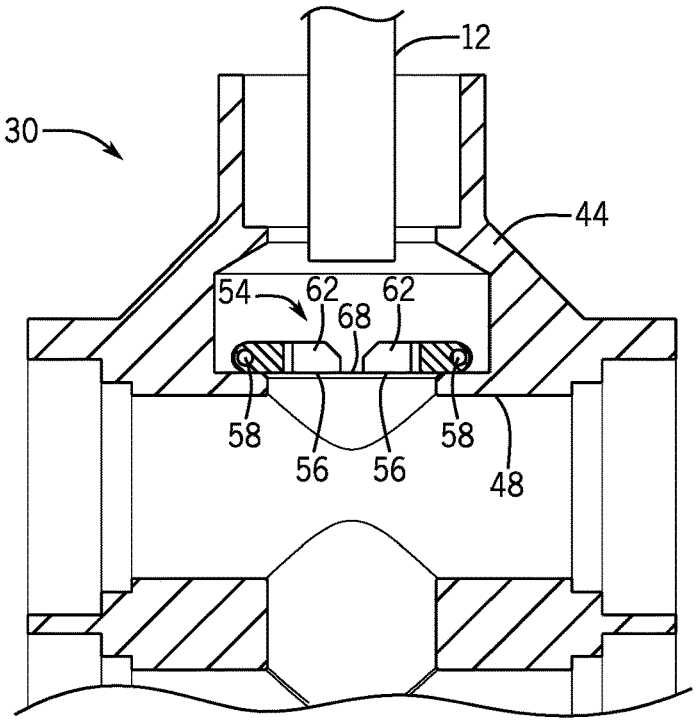
FIG. 5 depicts the rotatable doors of the flapper of FIGS. 3 and 4 in a closed position that impedes downward movement of the downhole tool in accordance with one embodiment.
Figure 6:
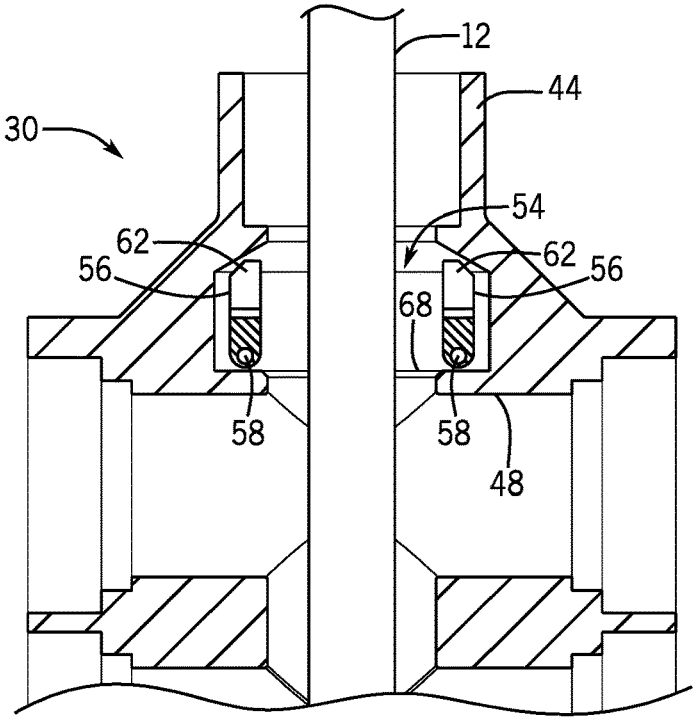
FIG. 6 depicts the rotatable doors of the flapper of FIGS. 3 and 4 in an open position that allows the downhole tool to be lowered through the wireline valve in accordance with one embodiment.

Operation of the flapper 54 may be better understood with reference to FIGS. 5-8, which generally show passage of the downhole tool 12 through the flapper 54. As will be appreciated, the tool 12 can be inserted into the lubricator 32 before being lowered through the wireline valve 30 into the well 14. The flapper 54 can be closed while the tool 12 is above the flapper 54, as depicted in FIG. 5. This allows the doors 56 of the flapper 54 to catch the tool 12 upon inadvertent disconnection of the tool 12 from the cable 16. The flapper 54 can be opened to permit the tool 12 to be lowered into the well, as generally shown in FIG. 6. The flapper 54 can be opened manually (e.g., via a handle extending through the valve body 44), through hydraulic actuation, or in any other suitable manner.

Figure 7:
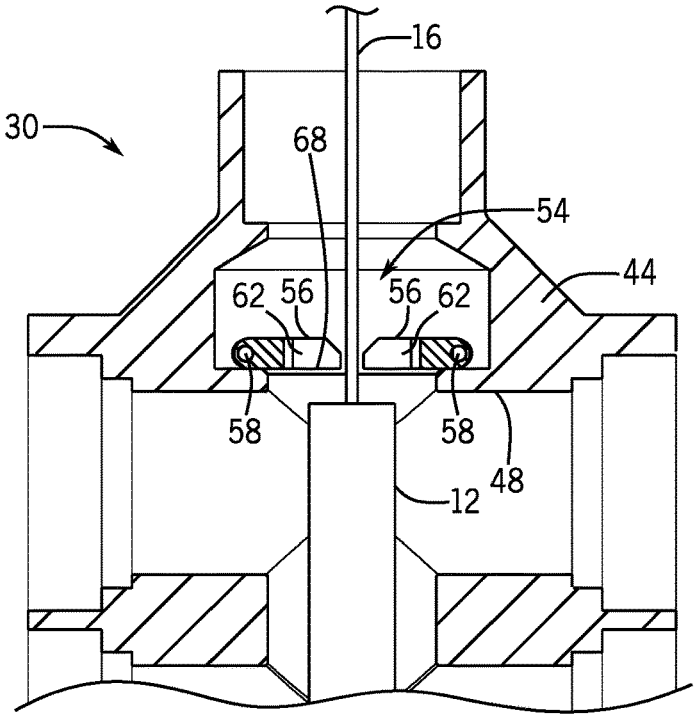
FIG. 7 shows the rotatable doors of the flapper of FIGS. 3 and 4 returned to the closed position following lowering of the downhole tool past the doors in accordance with one embodiment.

Once the tool 12 is lowered through the flapper 54, the doors 56 can be closed, such as shown in FIG. 7. In those embodiments in which the flapper 54 is biased toward its closed position, such as by springs 66, the doors 56 may automatically return to the closed position upon removal of the opening force (e.g., by releasing the handle or removing hydraulic opening pressure). In other instances, the doors 56 may be moved to the closed position manually, via hydraulic actuation, or in some other way. As noted above, the slots 62 in the doors 56 can allow the cable 16 to be raised or lowered through the flapper 54. The doors 56 can also or instead be arranged such that, when closed, ends of the doors 56 are spaced apart opposite one another to define a gap that allows the cable 16 to pass between the closed doors 56 through the gap. In such instances in which a suitable gap is provided between the closed doors 56, the slots 62 may be omitted. With the tool 12 suspended below the flapper 54, the tool 12 can be lowered into the well 14 for testing, sampling, or any other purpose.

Figure 8:
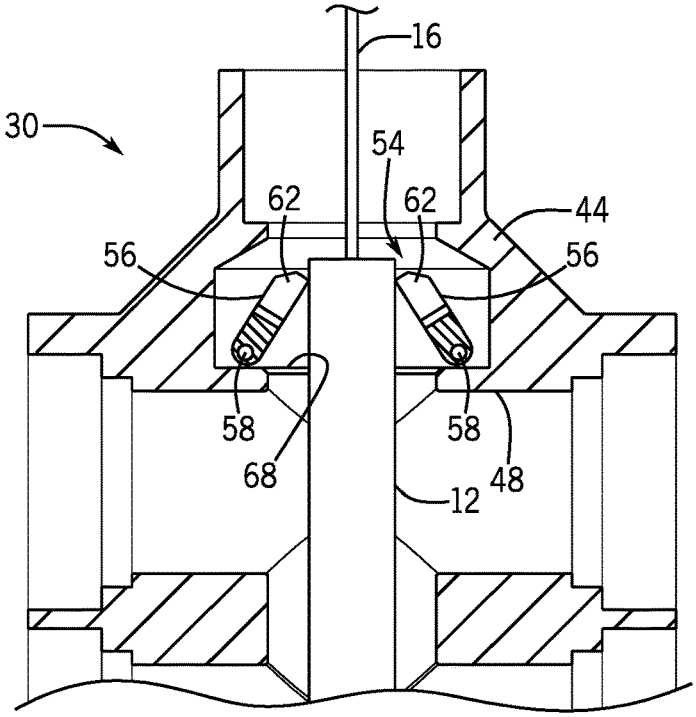
FIG. 8 shows the rotatable doors swinging upward as the downhole tool is drawn upward through the wireline valve past the doors in accordance with one embodiment.

When the tool 12 is to be retrieved, it may be pulled up from the well 14 and through the flapper 54, as depicted in FIG. 8. While the doors 56 are prevented (e.g., by the shoulder 68) from swinging downward to open the flapper 54, the doors 56 can swing open in the opposite direction. Consequently, when pulling the tool 12 out of the well 14 through the wireline valve 30, the upper end of the tool 12 pushes the doors 56 open and allows the tool 12 to be retracted into the lubricator 32 through the flapper 54. Once the bottom end of the tool 12 passes through the flapper 54, the springs 66 bias the doors 56 back into their closed position, as depicted in FIG. 5. This allows the flapper 54 to be positioned to catch the tool 12 if it is inadvertently released from the cable 16 and dropped.

Figure 9:
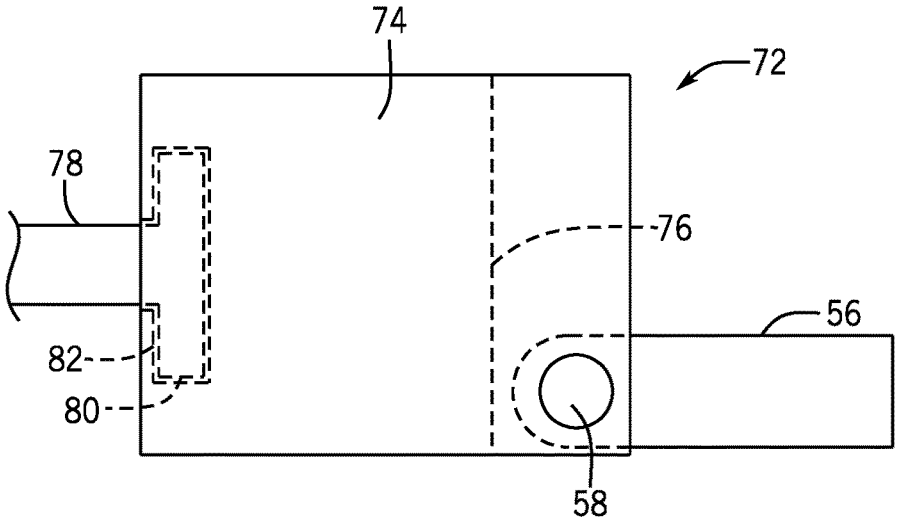
FIG. 9 is a side elevational view of a ram having a rotatable door that can be positioned within a bore of a wireline valve to selectively impede movement of the downhole tool through the bore in accordance with one embodiment.
Figure 10:
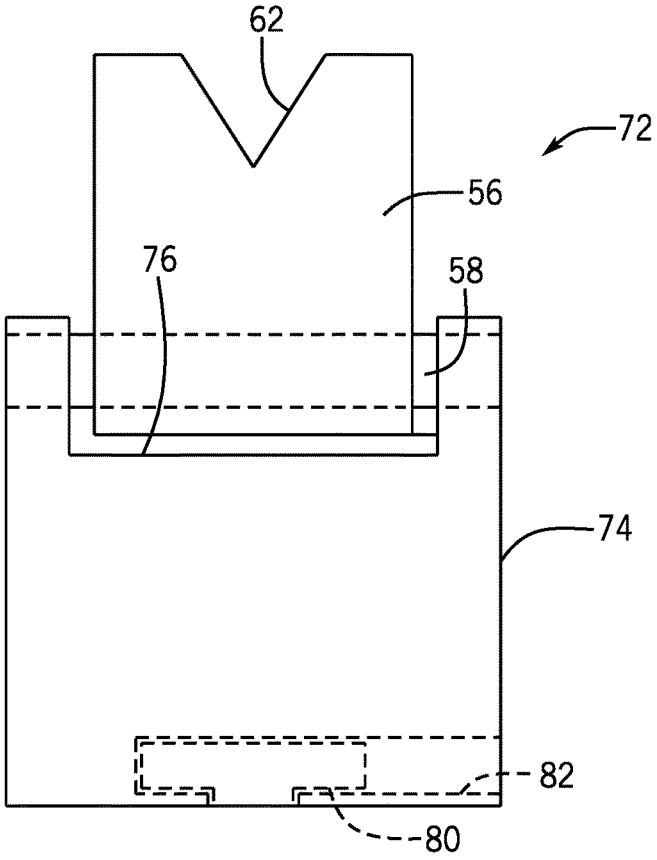
FIGS. 10 and 11 are top plan views of the ram of FIG. 9.
Figure 11:
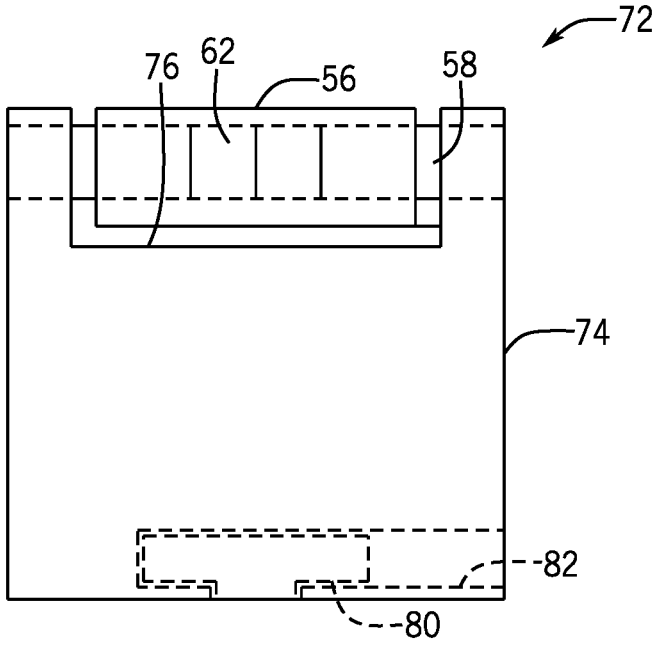

Although the flapper 54 is integrated into the valve body 44 in some embodiments, in other instances the flapper 54 is integrated into one or more rams of the wireline valve 30. One example of such a ram 72 is generally shown in FIGS. 9-11. In this depicted embodiment, the ram 72 includes a ram block 74 with a flapper door 56 able to rotate about a pivot 58. As above, the pivot 58 could be provided in any suitable form, such as a shaft, one or more pins, or some other axle. Although the ram 72 is depicted in FIGS. 9-11 as a rectangular ram, the ram 72 could have a different shape (e.g., a square ram, a circular ram, or an oval ram) in other embodiments.

The door 56 of the ram 72 can swing about the pivot 58 to selectively open and allow passage of a downhole tool 12 as generally discussed above. More particularly, the door 56 can be closed (as shown in FIGS. 9 and 10) to allow the door 56 to extend into the bore 46 of a wireline valve 30 and impede downward movement of a tool 12 past the ram 72, while allowing the door 56 to swing open (as shown in FIG. 11) to allow upward movement of the tool 12 past the ram 72 through the wireline valve 30. The ram block 74 includes a recess 76 for receiving the door 56 when fully opened, though it is noted that the door 56 may only be partially pushed opened in some instances, such as when a small-diameter tool 12 is pulled upward past the door 56. And as also noted above, the door 56 can include a slot 62 to facilitate travel of the cable 16 when the tool 12 is deployed in the well 14.

The ram 72 can be moved within a ram cavity 48 of the wireline valve 30 via a rod or shaft 78. In at least some embodiments, the ram 72 is operated manually or hydraulically. In the case of manual operation, the shaft 78 can be coupled to a handle (e.g., a handwheel) on the exterior of the wireline valve 30, and the handle can be rotated to move the ram 72 through the ram cavity 48 toward or away from the bore 46. For hydraulically actuated embodiments, the shaft 78 can be coupled to a piston (e.g., of a bonnet assembly connected to a valve body 44) and hydraulic pressure can be applied to the piston to drive movement of the ram 72 via the shaft 78. The shaft 78 can be coupled to the ram 72 in any suitable manner, but in at least some embodiments the shaft 78 includes a button 80 received in a mating slot 82 (e.g., a T-shaped slot) of the ram block 74.

Figure 12:
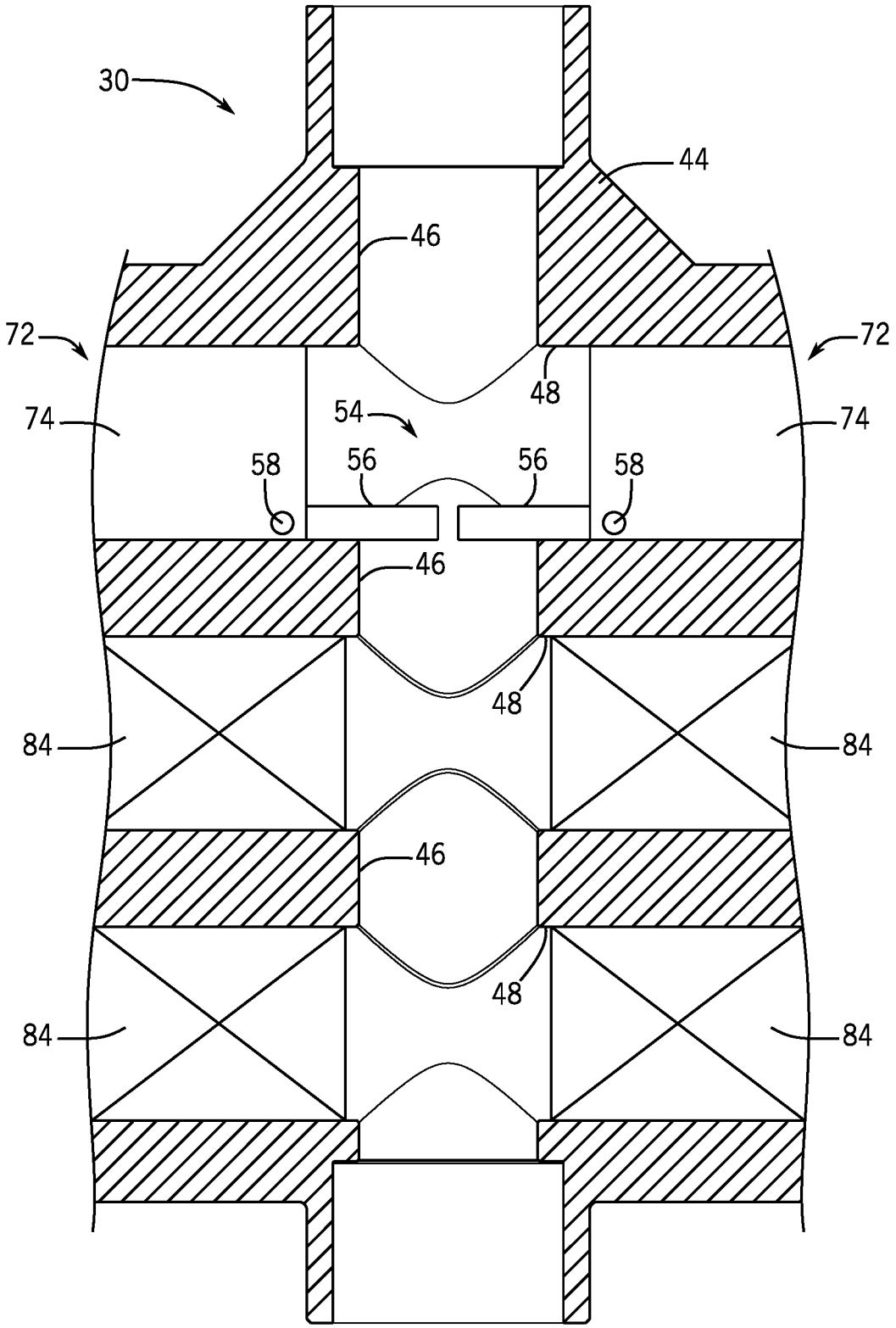
FIG. 12 is a sectional view depicting a pair of rams, such as that of FIG. 9, having rotatable doors in a closed position within a wireline valve to selectively impede movement of a downhole tool through a bore of the wireline valve in accordance with one embodiment.

A wireline valve 30 having a flapper 54 that includes rotatable doors 56 of two opposing rams 72 is depicted in FIG. 12 in accordance with one embodiment. In this example, the rams 72 are moved to extended positions within a ram cavity 48 in which the flapper doors 56 extend into the bore 46. As described above with respect to FIGS. 3-8, the closed doors 56 (as shown in FIG. 12) of the flapper 54 prevent passage of a downhole tool 12 down through the flapper 54, but can swing upward from the closed position to permit passage of a downhole tool 12 up through the flapper 54. In at least some embodiments, the doors 56 of the rams 72 are biased toward the closed position, such as by springs 66. Although depicted in FIG. 12 as having two opposing rams 72, it will be appreciated that the wireline valve 30 could use a single ram 72 having a rotatable door 56 as the flapper 54 or could use more than two rams 72 having doors 56 of the flapper 54 in other embodiments. The valve 30 can also include additional rams in other ram cavities 48 of the valve body 44, such as sealing rams 84 generically depicted in FIG. 12.

Figure 13:
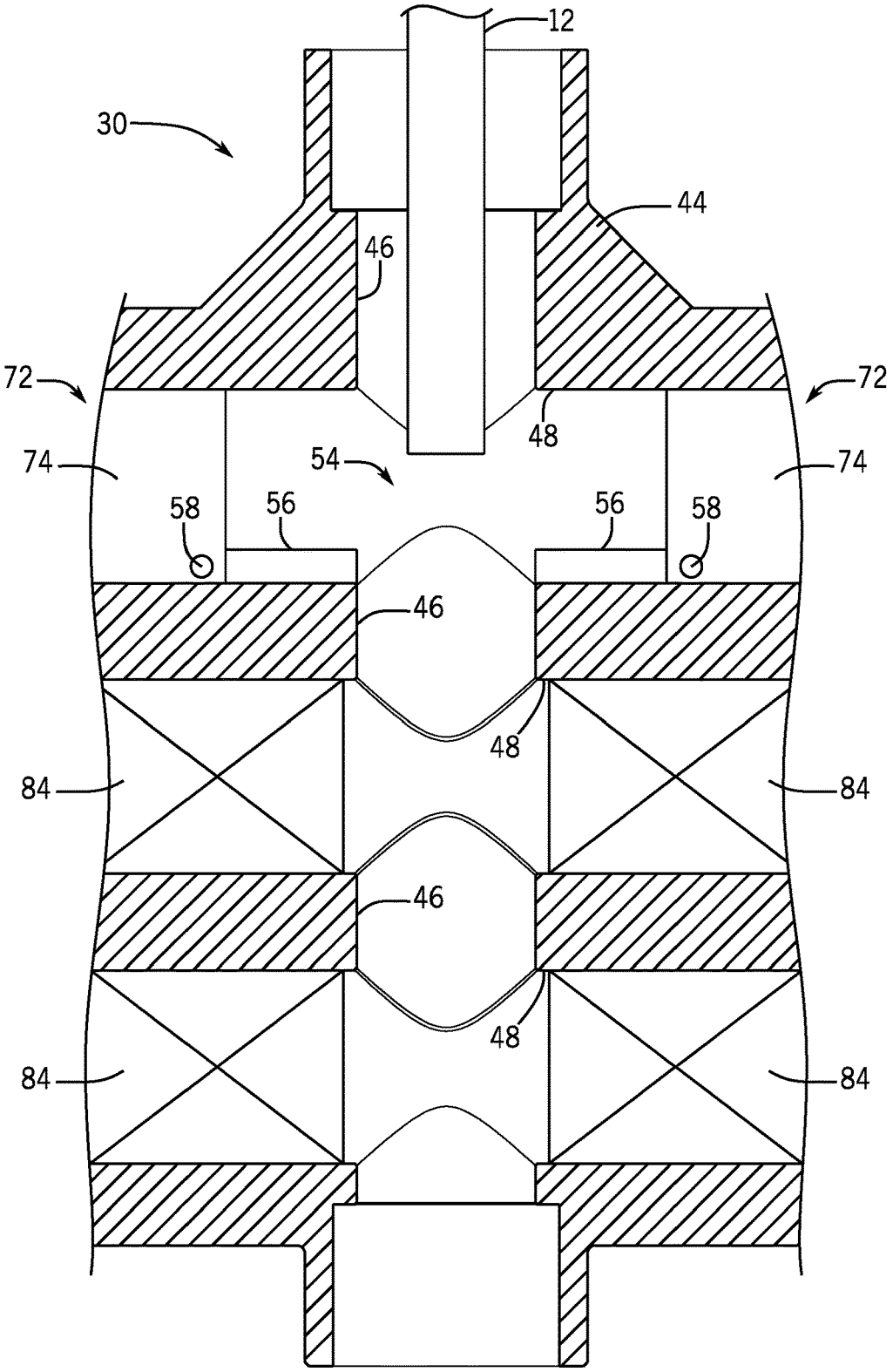
FIG. 13 depicts the rams having the rotatable doors in the wireline valve of FIG. 12 retracted away from the bore to an open position such that the rotatable doors are withdrawn from the bore to allow the downhole tool to be lowered through the wireline valve in accordance with one embodiment.
Figure 14:
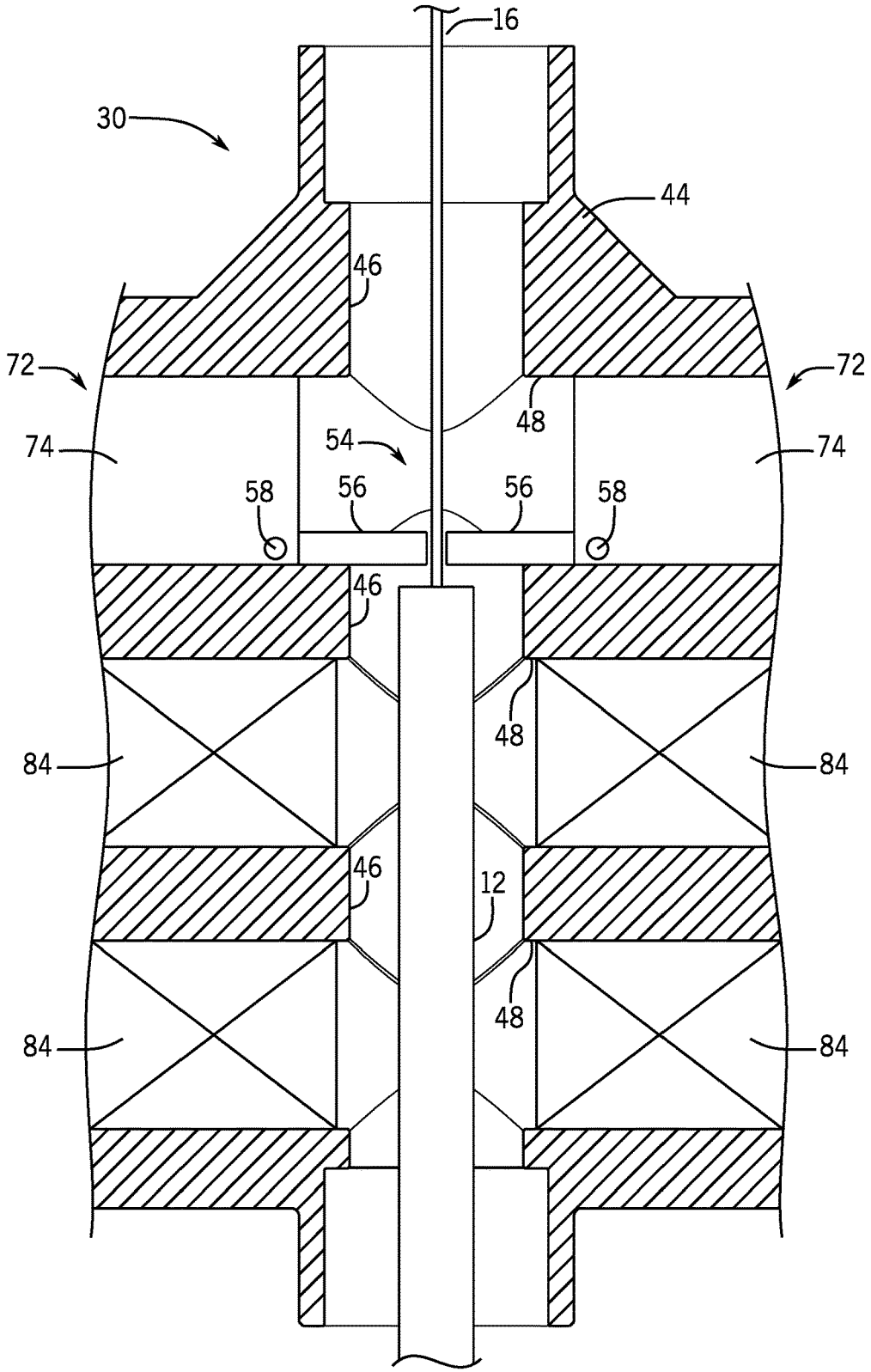
FIG. 14 depicts the rams having the rotatable doors in the wireline valve of FIG. 12 moved toward the bore to a closed position such that the rotatable doors extend into the bore above the wireline tool in accordance with one embodiment.
Figure 15:
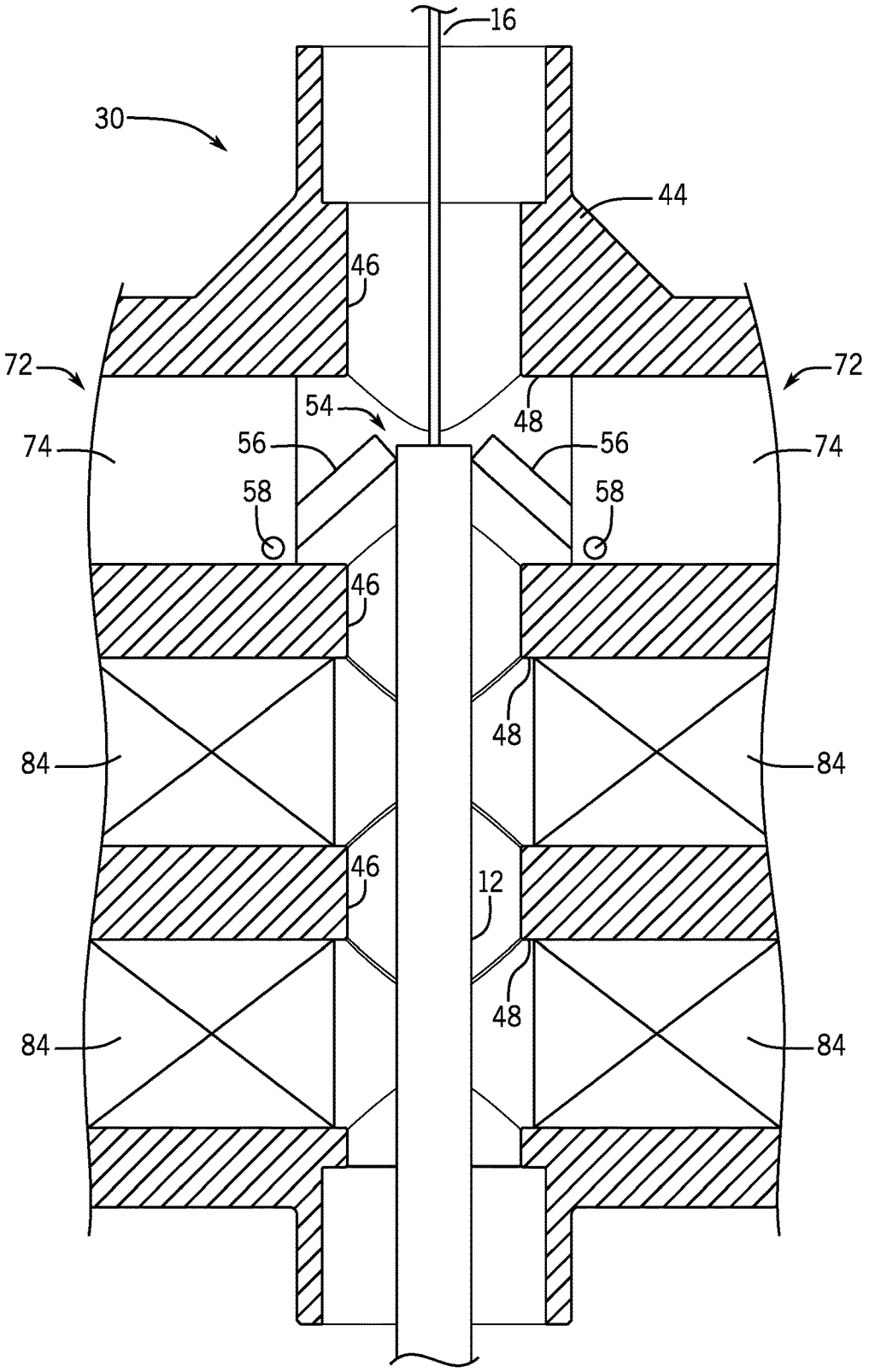
FIG. 15 depicts the rotatable doors of the rams in the wireline valve of FIG. 12 swinging upward as the downhole tool is drawn through the wireline valve past the doors in accordance with one embodiment.

In some embodiments, such as shown in FIG. 13, the flapper 54 can be opened by retracting the rams 72 so as to withdraw the doors 56 from the bore 46. A downhole tool 12 can be lowered (e.g., from the lubricator 32 via a wireline or slickline cable 16) through the bore 46 past the retracted rams 72. The rams 72 may then be extended to close the flapper 54 above the downhole tool 12 by positioning the doors 56 in the bore 46, as shown in FIG. 14. When the downhole tool 12 is to be retrieved, the tool 12 can be drawn upward through the bore 46 and through the doors 56, which swing outward when pushed by the upward moving tool 12, as shown in FIG. 15. This allows the tool 12 to be drawn upward past the doors 56 while the rams 72 remain in their extended position. When the bottom end of the downhole tool 12 passes through the doors 56, the doors 56 return to their closed position (as shown in FIG. 12) in which the doors 56 are arranged to prevent the tool 12 from falling down the well 14.

While the aspects of the present disclosure may be susceptible to various modifications and alternative forms, specific embodiments have been shown by way of example in the drawings and have been described in detail herein. But it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. An apparatus comprising:

a wireline valve comprising:

a main body with a bore sized to allow a downhole tool to pass through the main body of the wireline valve; and a flapper positioned within the main body with respect to the bore of the wireline valve such that the flapper can be moved between an open position and a closed position, wherein the flapper is configured to enable passage of the downhole tool through the bore of the main body of the wireline valve in a first direction and a second direction when the flapper is in the open position, and the flapper is configured to block passage of the downhole tool through the bore of the main body of the wireline valve in the first direction and to move in response to contact with the downhole tool to enable passage of the downhole tool through the bore of the main body of the wireline valve in the second direction when the flapper is in the closed position;

wherein the wireline valve comprises a ram that moves toward and away from the bore, wherein the flapper is coupled to the ram via a pivot, the flapper is configured to rotate about the pivot relative to the ram, and the flapper is configured to move with the ram as the ram moves toward and away from the bore.

2. The apparatus of claim 1, wherein the flapper includes opposing flaps.

3. The apparatus of claim 2, wherein the opposing flaps are spaced apart from one another when closed so as to provide a gap between the opposing flaps that facilitates passage of a cable between the opposing flaps.

4. The apparatus of claim 1, wherein the wireline valve is installed at a wellhead.

5. The apparatus of claim 4, comprising a lubricator coupled to the wireline valve, wherein the flapper is configured to block passage of the downhole tool in the first direction from the lubricator through the bore of the main body of the wireline valve toward the wellhead when the flapper is in the closed position, and to move in response to contact with the downhole tool to enable passage of the downhole tool in the second direction from the wellhead through the bore of the main body of the wireline valve toward the lubricator when the flapper is in the closed position.

6. The apparatus of claim 1, wherein the flapper is biased toward the closed position.

7. The apparatus of claim 1, comprising an additional ram opposing the ram, wherein the additional ram and the ram each include a respective rotatable door of the flapper.

8. An apparatus comprising:

a ram blowout preventer comprising:

a hollow main body comprising a bore and a ram cavity;

a ram positioned in the ram cavity such that the ram can be moved within the ram cavity toward and away from the bore;

a rotatable flap coupled to the ram, wherein the rotatable flap is configured to block movement of a tool through the bore in a first direction toward a wellhead when the ram blowout preventer is mounted above the wellhead and when the rotatable flap is positioned within the bore, and the rotatable flap is configured to rotate upon contact with the tool to enable movement of the tool through the bore in a second direction opposite the first direction and away from the wellhead when the ram blowout preventer is mounted above the wellhead and when the rotatable flap is positioned within the bore.

9. The apparatus of claim 8, wherein the ram blowout preventer is mounted above the wellhead.

10. The apparatus of claim 8, wherein the rotatable flap is configured to move with the ram within the ram cavity, and the rotatable flap is positioned within the bore when the ram is in an extended position within the ram cavity.

11. The apparatus of claim 10, comprising:

an additional ram positioned in the ram cavity such that the additional ram can be moved within the ram cavity toward and away from the bore; and an additional rotatable flap coupled to the additional ram.

12. The apparatus of claim 8, wherein the ram blowout preventer comprises:

an additional ram cavity; and a first sealing ram and a second sealing ram positioned in the additional ram cavity, wherein the first sealing ram and the second sealing ram are configured to move within the additional ram cavity toward and away from the bore, and the first sealing ram and the second sealing are configured to move toward the bore to contact one another to seal the bore.

13. The apparatus of claim 8, comprising a wellhead stack assembly the ram blowout preventer and a lubricator coupled to the ram blowout preventer, wherein the wellhead stack assembly does not include a tool trap coupled between the ram blowout preventer and the lubricator.

14. A method comprising:

lowering a downhole tool through a bore of a blowout preventer of a wellhead assembly;

moving a ram of the blowout preventer to position a rotatable flap of the ram in the bore above the downhole tool; and drawing the downhole tool upward through the bore past the rotatable flap, wherein the downhole tool causes the rotatable flap to swing outward as the downhole tool is drawn upward through the bore past the rotatable flap.

15. The method of claim 14, comprising moving the ram of the blowout preventer to retract the rotatable flap of the ram from the bore of the blowout preventer.

16. The method of claim 14, wherein lowering the downhole tool through the bore of the blowout preventer includes lowering the downhole tool into a well via a wireline or a slickline.

17. The method of claim 14, comprising coupling a lubricator to the blowout preventer as part of the wellhead assembly such that the lubricator is not coupled to the blowout preventer via a tool trap.

18. An apparatus comprising:

a wireline valve comprising:

a main body with a bore sized to allow a downhole tool to pass through the main body of the wireline valve; and a flapper positioned within the main body with respect to the bore of the wireline valve such that the flapper can be moved between an open position and a closed position, wherein the flapper is configured to enable passage of the downhole tool through the bore of the main body of the wireline valve in a first direction and a second direction when the flapper is in the open position, and the flapper is configured to block passage of the downhole tool through the bore of the main body of the wireline valve in the first direction and to move in response to contact with the downhole tool to enable passage of the downhole tool through the bore of the main body of the wireline valve in the second direction when the flapper is in the closed position wherein the wireline valve comprises a ram positioned within the main body, and the ram is configured to move along a ram axis that is crosswise to a central axis of the bore between an extended position in which the ram extends into the bore and a retracted position in which the ram is withdrawn from the bore; and wherein the flapper is coupled to the ram and is configured to move with the ram as the ram moves along the ram axis that is crosswise to the central axis of the bore, the flapper is in the open position when the ram is in the extended position, and the flapper is in the closed position when the ram is in the retracted position.

* * * * *